US011286098B2

(12) United States Patent
Tsai et al.

(10) Patent No.: US 11,286,098 B2
(45) Date of Patent: Mar. 29, 2022

(54) RESEALABLE CONTAINER CAP

(71) Applicant: Lenntek Corporation, Torrance, CA (US)

(72) Inventors: Danny Tsai, Torrance, CA (US); Jeffrey Tsai, Torrance, CA (US); Michael Tsai, Torrance, CA (US)

(73) Assignee: Lenntek Corporation, Torrance, CA (US)

( * ) Notice: Subject to any disclaimer, the term of this patent is extended or adjusted under 35 U.S.C. 154(b) by 0 days.

(21) Appl. No.: 17/247,377

(22) Filed: Dec. 9, 2020

(65) Prior Publication Data

US 2021/0171267 A1 Jun. 10, 2021

Related U.S. Application Data

(60) Provisional application No. 62/945,276, filed on Dec. 9, 2019.

(51) Int. Cl.
*B65D 81/20* (2006.01)

(52) U.S. Cl.
CPC ..... *B65D 81/2038* (2013.01)

(58) Field of Classification Search
CPC ..... B65D 81/2038; A61J 1/14; A61J 1/1406; A61J 1/1412; A61J 1/2003; A61M 1/0003; A61M 1/0011; B67C 11/00; B67C 11/02
USPC ..... 141/65
See application file for complete search history.

(56) References Cited

U.S. PATENT DOCUMENTS 2,128,128 A 8/1938 Evans
2,224,296 A 12/1940 Hoffman
5,031,785 A * 7/1991 Lemme ..... B65B 31/047 215/228
5,465,857 A * 11/1995 Yang ..... B65B 31/047 137/522
5,535,900 A * 7/1996 Huang ..... B65B 31/047 137/522
6,637,321 B2 * 10/2003 Wang ..... A23L 3/3418 99/472
6,651,834 B2 * 11/2003 Wong ..... B65D 79/0087 215/260
6,976,669 B2 * 12/2005 Van Zijll Langhout ..... B65D 83/46 251/342
8,640,746 B2 * 2/2014 Luis ..... B65B 31/047 141/65
8,701,910 B1 * 4/2014 Michalopoulos .. B65D 81/2038 215/311
9,505,599 B2 * 11/2016 Marantis ..... A61M 1/0003
9,517,922 B2 * 12/2016 Marantis ..... A61M 1/0011
9,708,114 B2 * 7/2017 Moon ..... B65D 81/2015
10,246,239 B2 * 4/2019 Lee ..... B65D 39/16
10,745,180 B2 * 8/2020 Duckworth ..... B65D 51/18
(Continued)

FOREIGN PATENT DOCUMENTS

CN 104443816 A 3/2015

OTHER PUBLICATIONS

International Search Report and Written Opinion, PCT/US2020/064028, Feb. 26, 2021.

*Primary Examiner* — Timothy L Maust
(74) *Attorney, Agent, or Firm* — Fitzgerald IP Law; John K Fitzgerald, Esq.

(57) ABSTRACT

A resealable cap having a valve-type plug incorporated therein, and a device for manipulating the valve-type plug into a closed, sealed, position to maintain a decreased pressure in a container.

6 Claims, 6 Drawing Sheets

(56) References Cited

U.S. PATENT DOCUMENTS

| | | | | |
|---|---|---|---|---|
| 10,752,422 | B2 * | 8/2020 | Gubler | B65D 51/1683 |
| 2003/0070563 | A1 | 4/2003 | Wang | |
| 2016/0136048 | A1 | 5/2016 | Marantis et al. | |
| 2016/0257475 | A1 * | 9/2016 | Gervais | B65D 43/0214 |

* cited by examiner

RESEALABLE CONTAINER CAP

BACKGROUND

This disclosure relates generally to resealable caps configured to close and seal the top of a container. More particularly, the present disclose relates to caps that seal the neck of a container, and include a valve integrated into the top of the cap through which a vacuum can be drawn within the container and them maintained by the cap and valve.

Containers of various sizes and shapes are commonly used to store various liquids and substances. The quality of many such liquids and substances is subject to deterioration after the permanent bottle seal, required for transport and storage, is removed and only part of the contents are consumed. The liquid or substance then comes into contact with the air after opening of the container. Many devices and systems have been proposed to reduce or eliminate such deterioration.

In many systems, a pump device is used to remove at least a substantial portion of the air from the container, thereby drawing a vacuum within the bottle. A stopper is installed in the neck of the container to maintain the vacuum and prevent the ingress of air. One such system includes an integral stopper and valve assembly composed of an elastic material. The stopper shaft has an axial channel and the valve has an opening in the form of a slit which is located in the path of the channel. The valve can open outwards, allowing the slit to open, to permit the extraction of air from the container. The slit is held closed by the elastic properties of the material and/or by the pressure difference across the valve. A pump comprising a cylinder, a piston disposed in the cylinder, and a valve is used to draw the vacuum in the bottle.

Variations of such a system wherein the slit is replaced by a pneumatically operated valve that allows a vacuum to be drawn on the container and then maintain the vacuum by sealing the cap have also been devised. In such systems, a pump is positioned over the top of the cap and the upstroke of the pump creates a vacuum above the valve, causing the valve to open and allowing air to be evacuated from the container. When the pump piston is pushed down in preparation for another upstroke, the vacuum created in the container pulls the valve down to seal the vacuum in the container. This process is continued until a desired amount of vacuum is obtained in the container. It will also be understood that at some point the vacuum generated by an upstroke of the pump is not sufficient to overcome the vacuum in the container, and the valve will not be able to open to allow additional air to be evacuated.

Such systems are relatively simple to use and inexpensive to manufacture. However, the seal formed by the valve is subject to several failure mechanisms. Such a slit is difficult to clean and may become fouled with liquid from the bottle, dust or the like. Should the valve fail and allow air to enter the bottle, such failure will remain undiscovered until an attempt is made to remove the stopper, allowing deterioration of the contents to progress undetected. In other cases, the valve may become distorted and allow air to seep past the valve, which may lead to deterioration of the contents of the container.

What has been needed but not previously been available is a resealable cap configured to allow a vacuum to be drawn within the container, and having a valve which can be manually actuated to affect a seal on the container. Such a valve will be easy to manufacture and provide for a positive and lasting seal of the cap. The present invention satisfies these and other needs.

SUMMARY OF THE INVENTION

In its most general aspect, the present disclosure includes a cap into which a moveable valve-type plug has been incorporated. When the cap is attached to a container, a device configured to produce a reduced pressure with the container may be applied to a top surface of the cap, and used to reduce the pressure of air or gas in the interior of the closed container. When the desired level of reduced pressure is created within the container, a piston or rod including in the device is used to push the plug into sealed engagement with the cap, maintaining the reduced pressure within the container.

In another aspect, the present disclosure includes a resealable container cap with a plug configured to allow a pump to draw a vacuum on a container when the cap is closed on the container, comprising: a cap portion, a valve disposed in the cap portion, the valve configured to create a gas passageway when the valve is in an open position, allowing a pump to evacuate gas from the interior of a container to which the cap is applied, the valve configured to move to a closed position that closes the gas passageway to maintain a reduced pressure within the container.

In still another aspect, the present disclosure describes a system for creating and maintaining a reduced pressure within a container, comprising: a container having a body portion and a neck portion, the container also having a bore through the neck portion to allow access to an interior of the container; threads disposed on an outer surface of the neck portion; a gasket mounted on a top edge of the neck portion; a cap configured to fit over the gasket and neck portion of the container, the cap also having threads disposed on an interior surface of the cap and configured to engage the threads disposed on the outer surface of the neck portion; and, a moveable valve-like plug disposed through a thickness of the cap, the moveable valve-like plug having an open position and a closed position, the open position creating a passageway through the cap between the interior of the container and the environment, the closed position closing the passageway.

In an alternative aspect, the system for creating and maintaining a reduced pressure within a container may further comprise a device configured to mate with a top surface of the cap, the device being configured to be used to generate a decreased pressure above the moveable valve-like plug to move the moveable valve-like plug into the open position. In another alternative aspect, the device includes a pump. In yet another alternative aspect, the pump is a moveable piston operating within a close-fitting bore. In still another alternative aspect, the moveable piston is configured to push the moveable valve-like plug into the closed position.

Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENTS

As will be described hereinafter in greater detail, the various embodiments of the present invention relate to an apparatus and method for providing a resealable cap for a container, the cap including a port and resealable plug, and is configured to cooperate with a vacuum pump or other device for reducing a pressure in the interior of the container. For purposes of explanation, specific nomenclature is set forth to provide a thorough understanding of the present invention. Description of specific applications and methods are provided only as examples. Various modifications to the embodiments will be readily apparent to those skilled in the art and the general principles defined herein may be applied to other embodiments and applications without departing from the spirit and scope of the invention. Thus the present invention is not intended to be limited to the embodiments shown, but is to be accorded the widest scope consistent with the principles and steps disclosed herein.

In describing the various figures herein, the same reference numbers are used throughout to describe the same element that appears in more than one embodiment of the present invention. Detailed descriptions of various elements that appear in more than one embodiment is not repeated in the descriptions of following figures, even though such element is labeled with the same reference number.

Figure 1:
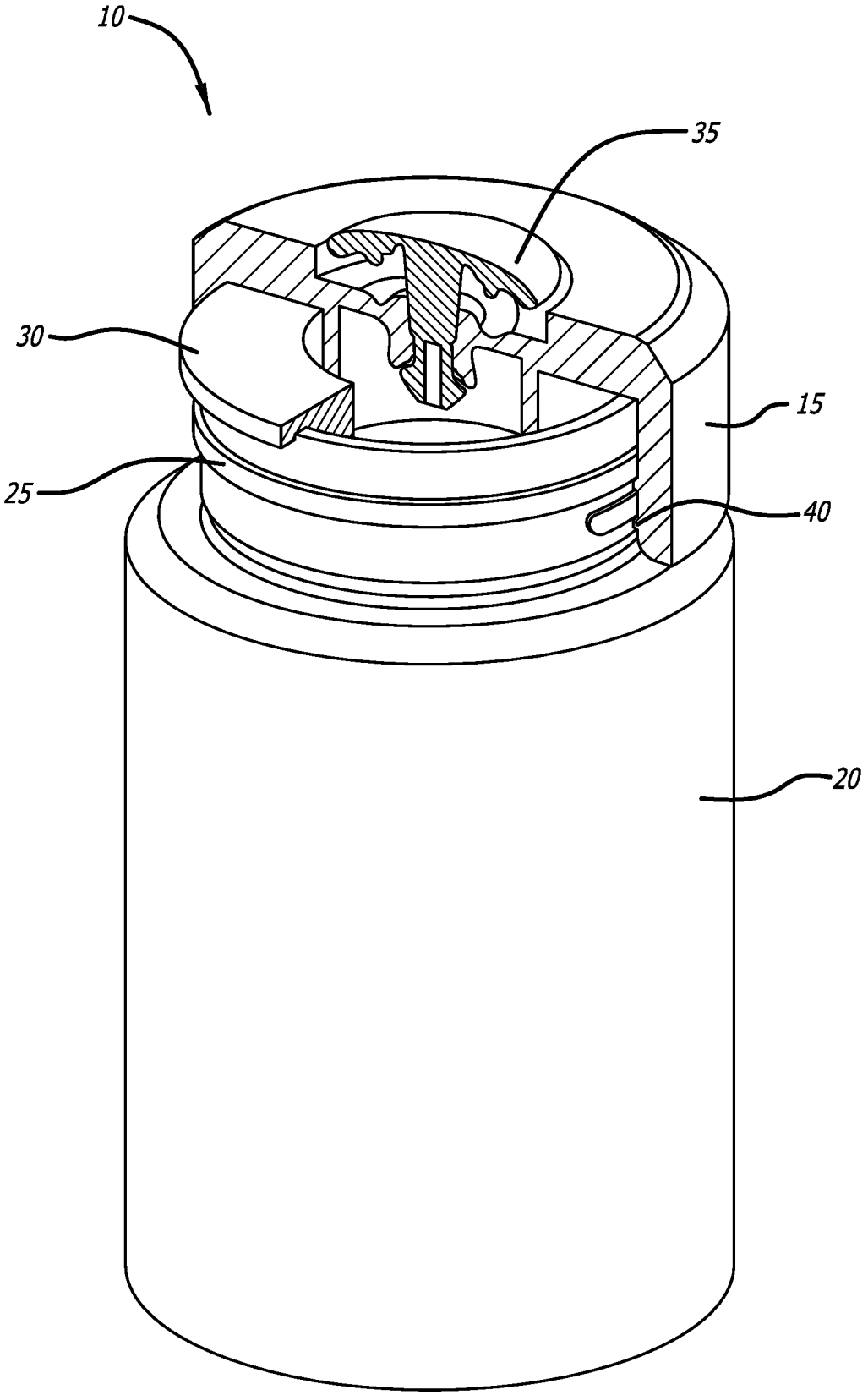
FIG. 1 is a perspective view of an embodiment of the present disclosure having a container including a cap, the cap shown in partial cross-section, the cap including a moveable plug providing sealable access to an interior of the container, the moveable plug being shown in an open configuration.

FIG. 1 illustrates an embodiment 10 showing a container 20 that is closed with a removeable cap 15. The cap has threads 40 configured to engage threads 25 disposed on a top portion of the container 20. To insure that an air-tight seal, a gasket 30 is disposed around the top of a top opening of the container. The gasket 30 engages a sealing portion of the cap, as will be described in more detail below.

As shown, the cap includes a moveable plug 35. In this figure, the plug is shown in an open position, which allows air to be evacuated from the interior of the container in a manner which allows the plug to be moved into a closed position, described in more detail below, once the air pressure in the container has been reduced to a desired pressure.

Figure 2:
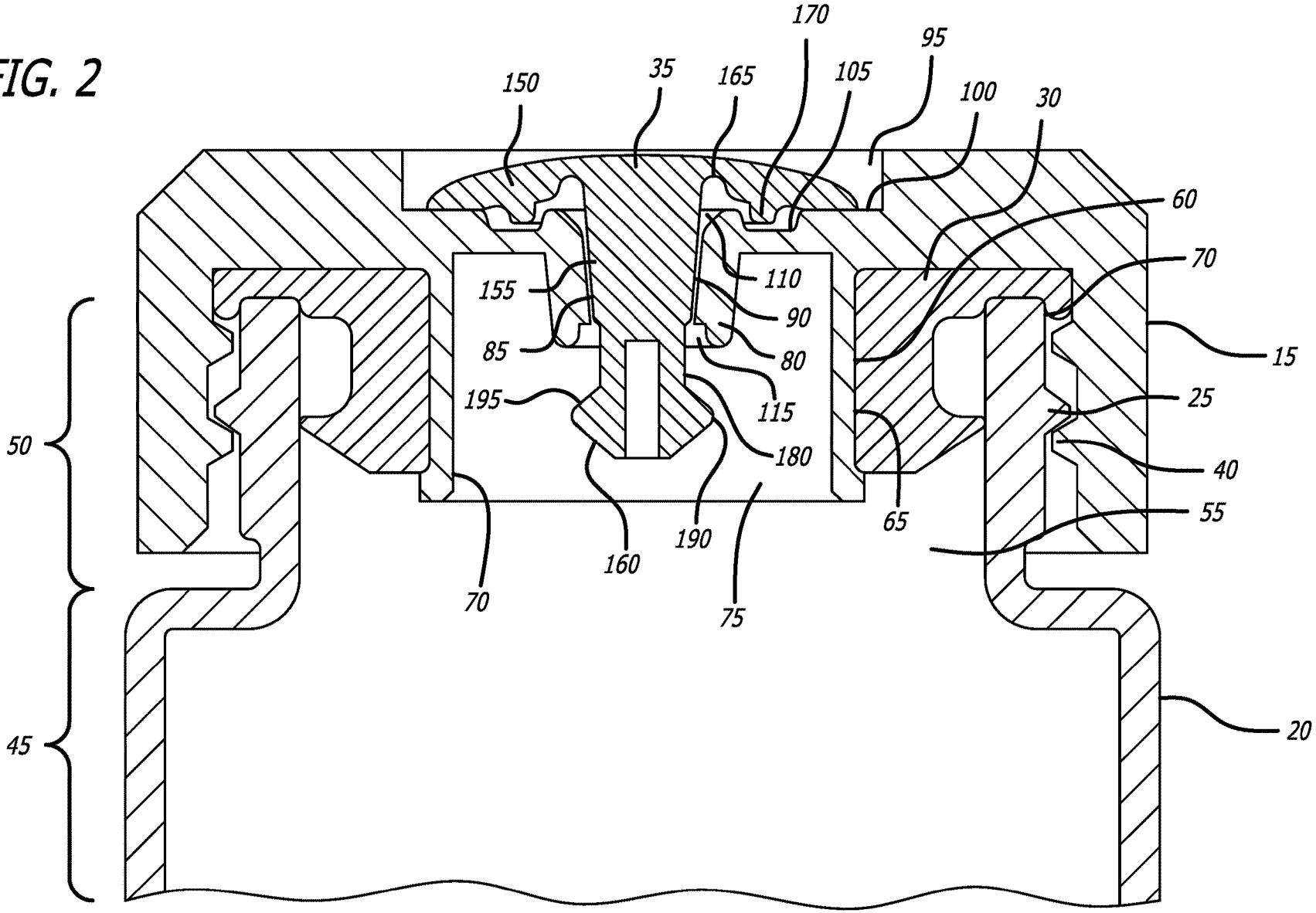
FIG. 2 is a cross-sectional enlarged view of the embodiment of FIG. 1 showing the moveable plug in a closed configuration.

FIG. 2 is a cross-sectional view of the cap 15 and container 20, showing additional details of the gasket, cap, and plug. As shown, container 20 has a body portion 45 and a neck portion 50. Threads 25 are disposed on an outer surface of the neck portion, and are configured to engage threads 25 disposed on a portion of cap 15.

In one embodiment, body portion 45 has a first inner diameter, which is greater than an inner diameter of neck portion 50. Those of ordinary skill in the art will understand that this configuration may be reversed, that is, the neck portion may have a greater inner diameter than the inner diameter of the body portion, or, alternatively, inner diameters of the body and neck portions may be approximately the same, without departing from the scope of the intended invention.

As shown in FIG. 2, the inner diameter of the neck portion defines a bore 55. In this embodiment, a gasket 30 is inserted into the bore 55. Gasket 30, which is annular in shape, has a central opening 60 defined by wall 65. Gasket 30 also has an annular recess formed in a top portion, which is configured to engage with an upper portion of the neck portion of the container. When the gasket 30 is inserted into the opening of the neck portion of container 20, it mates with the top portion of the neck portion in a sealable configuration. As those of ordinary skill in the art will understand, when a cap is tightened upon the neck portion of the container, the engagement of the threads of the neck portion of the container and the threads of the cap cause the cap to tighten against the gasket to seal the top opening of the container.

An embodiment of the cap of the present disclosure is shown tightened up the neck portion of the container. In this embodiment, the cap has a central wall 70 that is sized to be sealably received in the central opening 60 of the gasket with an outer side of wall 70 engaging with wall 65 of the central opening of the gasket.

The inner surface of wall 70 of the cap defines a second bore 75. A second annular wall 80 is formed in the cap, extending into the second bore 75. The interior side 85 of annular wall 80 defines a third bore 90. As shown, the bore of this exemplary embodiment has a distal portion and a proximal portion, the proximal portion opening into the interior of the container. Bore 90 may be configured to taper from the distal end of the bore to the proximal end of the bore.

Referring now to an outer distal end of cap 15, a fourth bore 95 is disposed in a distal end portion of the cap. The bore has an outer diameter that is greater than an inner diameter of bore 90. An annular land 100 is formed at a bottom surface of bore 95. Land 100 extends from a surface of the cap that defines the opening of the bore 95 radially towards the center of the bore to define a sealing surface. An annular recess 105 may be formed in land 100. Additionally, an upper portion of the land that intersects with bore 90 may include a chamfer 110.

In one embodiment, a bore 115 may be formed at a proximal end of annular wall 80.

One embodiment of plug 35 will now be described. Plug 35 is configured to be received into bores 95, 90, 95, and 75 of the cap. Plug 35 includes a top portion 150 configured to seal against land 100 of the cap when the plug is in a closed, sealed, position. The plug 35 also has a body portion 155 that extends proximally to a proximal portion 160 that is configured to engage with the proximal end of annular wall 85 when the plug is in an open position. In some embodiments, top portion 150 of plug 35 includes an annular wall 170 extending from a bottom surface of the top portion 150 and configured to engage recess 105 of the cap when the plug is in a closed position to provide additional sealing to ensure that a reduced pressure within the container may be preserved after the air or other gas is evacuated from the interior of the container. In other embodiments, an annular well 165 may be formed in the bottom side of the top portion 150. Such a well results in a thinning of a thickness of the top portion at the location of the annular well 165, which may act as a hinge to provide increased flexibility of the top portion of the plug to enhance the ability of the top portion to form an improved seal with land 100.

Body portion 155 tapers from a distal end diameter to a proximal end. The taper portion of the body portion is sized to closely cooperate with bore 90 so as to seal bore 90 when the plug is in a closed, sealed, position.

Proximal portion 160 of plug 35 has a top portion having a smaller diameter than a diameter of a distal end to body portion. The smaller diameter of the top portion extends to a top end of a distal portion of the proximal portion. The top portion of the proximal portion 160 includes an annular portion 190 having a larger diameter than that of the distal portion of the top end of the portion of the proximal portion of the plug. In some embodiments, annular portion 190 is formed so that the proximal edge of annular portion 190 is formed as a ramp 195 between the end of the proximal portion of proximal portion 160. The ramp is designed to cooperate with bore 115 so that when the plug is in an open position, an air passage is formed that allows air to be evacuated from the interior of the container. In some embodiments, a second ramp 200 may be formed at the bottom portion of annular portion 190. In some embodiments, a central bore 205 may be formed in a central portion of the proximal portion 160 extending from the proximal end of proximal portion 160 distally for a selected distance.

Figure 3:
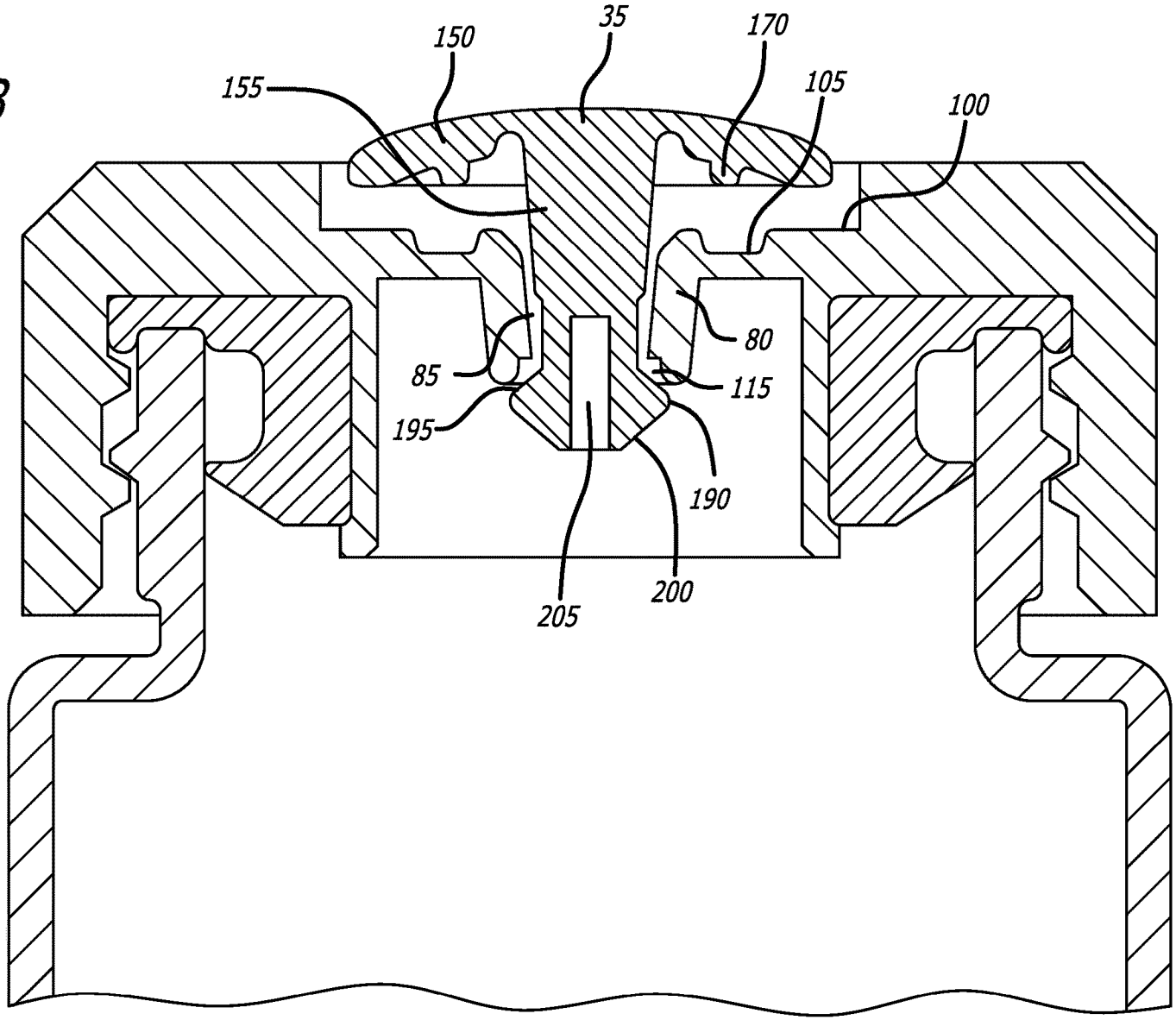
FIG. 3 is cross-sectional enlarged view of the embodiment of FIG. 1 showing the moveable plug in an open configuration.

FIG. 3 depicts the embodiment of FIG. 3 illustrating the plug 35 in an open, unsealed position. When the plug is pulled up, the top portion moves distally in relation to the container, resulting in the forming of a passageway from the container to the exterior of the cap. As shown, when in an open position, annular wall 170 disengages with recess 105, and the top portion disengages with land 100. Due to the cooperating tapers between the body portion 155 and the inner surface 85 of annular wall, and the configuration of ramp 190 and bore 115, an air or gas passage way is created, allowing passage of air or gas into or out of a volume defined by the interiors of the container and cap.

Figure 4:
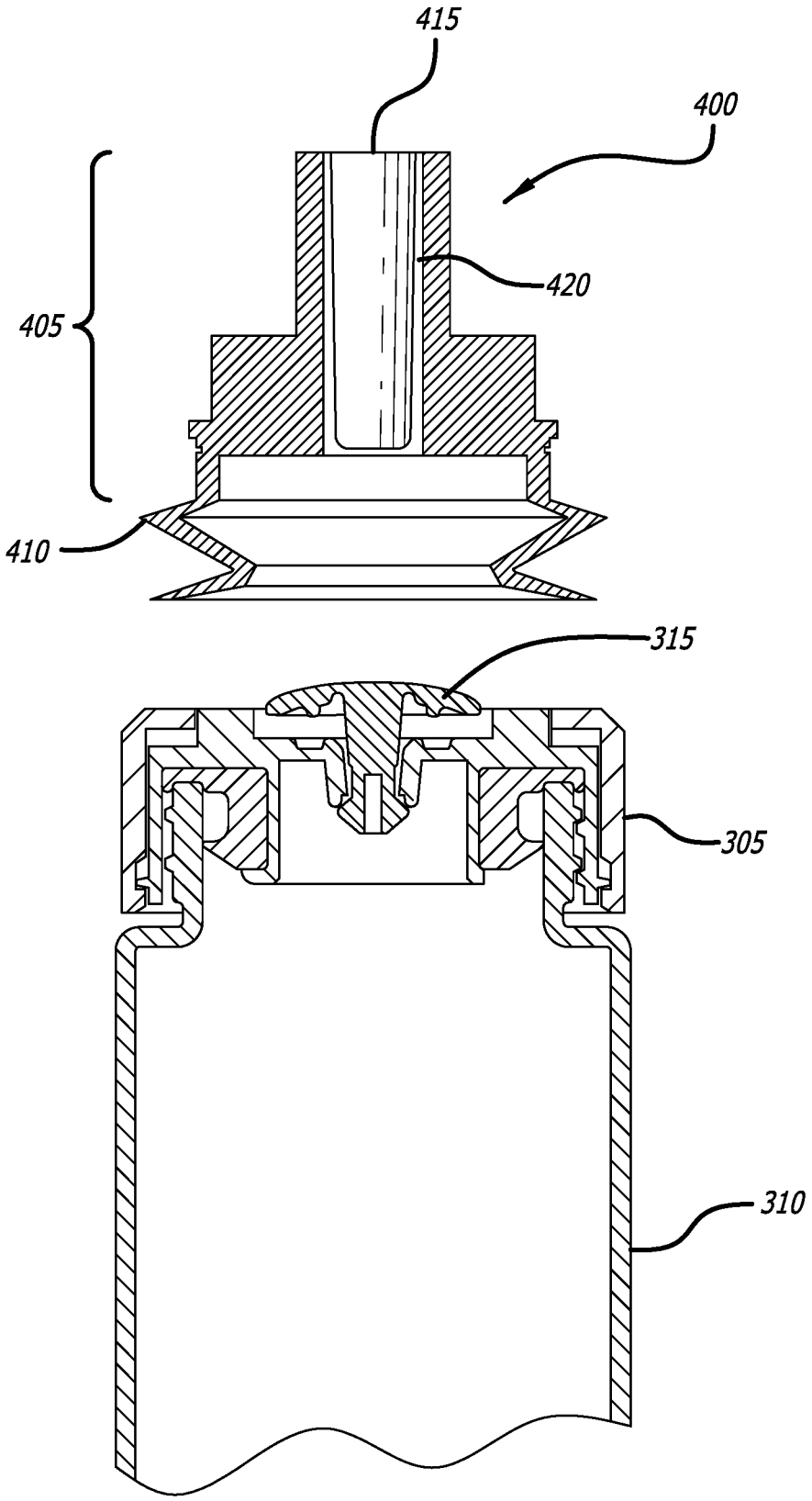
FIG. 4 is side partial cross-sectional view of the cap and plug of FIG. 1 mounted on a container and a device configured to attach to a top surface of the cap and to reduce a gas pressure within an interior of the container.

FIG. 4 is a partial cross-sectional view of an embodiment of the current disclosure wherein a cap 305 having an embodiment of the plug 315 of the present disclosure tightened upon a container 310. The plug 315 is shown in an open position. An embodiment of fixture 400 in accordance with the subject matter of this disclosure is shown positioned over the top surface of cap 315. Fixture 400, as shown, is configured to be applied to the top surface of the cap 305. Fixture 400 includes a top portion 405 and bottom portion 410. In one embodiment, bottom portion 410 may be formed in the shape of a bellows or other construction designed to promote an air tight seal between the proximal end of the bottom portion and the top surface of the cap 305.

Fixture 400 includes a piston or rod 415 inserted into bore 420 of the top portion 405. The diameter of piston 415 is sized to provide a movable, but sealed, communication with the wall of bore 420.

Figure 5:
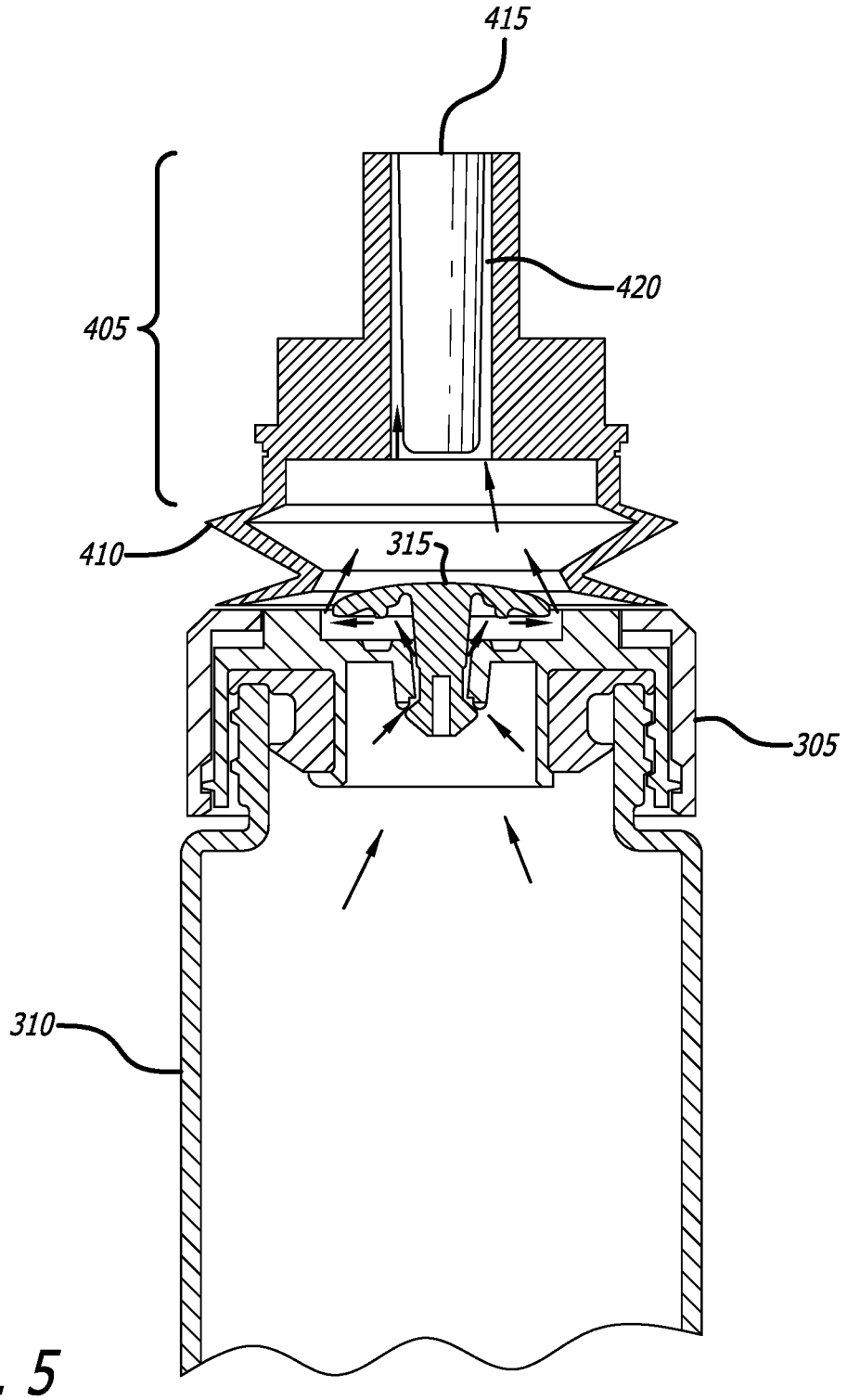
FIG. 5 is a side partial cross-sectional view of the cap mounted on the container, and the device configured to reduce the gas pressure within the interior of the container, illustrating the formation of a gas passageway through the plug into the interior of the container and the flow of gas or air out of the cap and container through the plug and into the pressure reducing device when the plug is in the open configuration.
Figure 6:
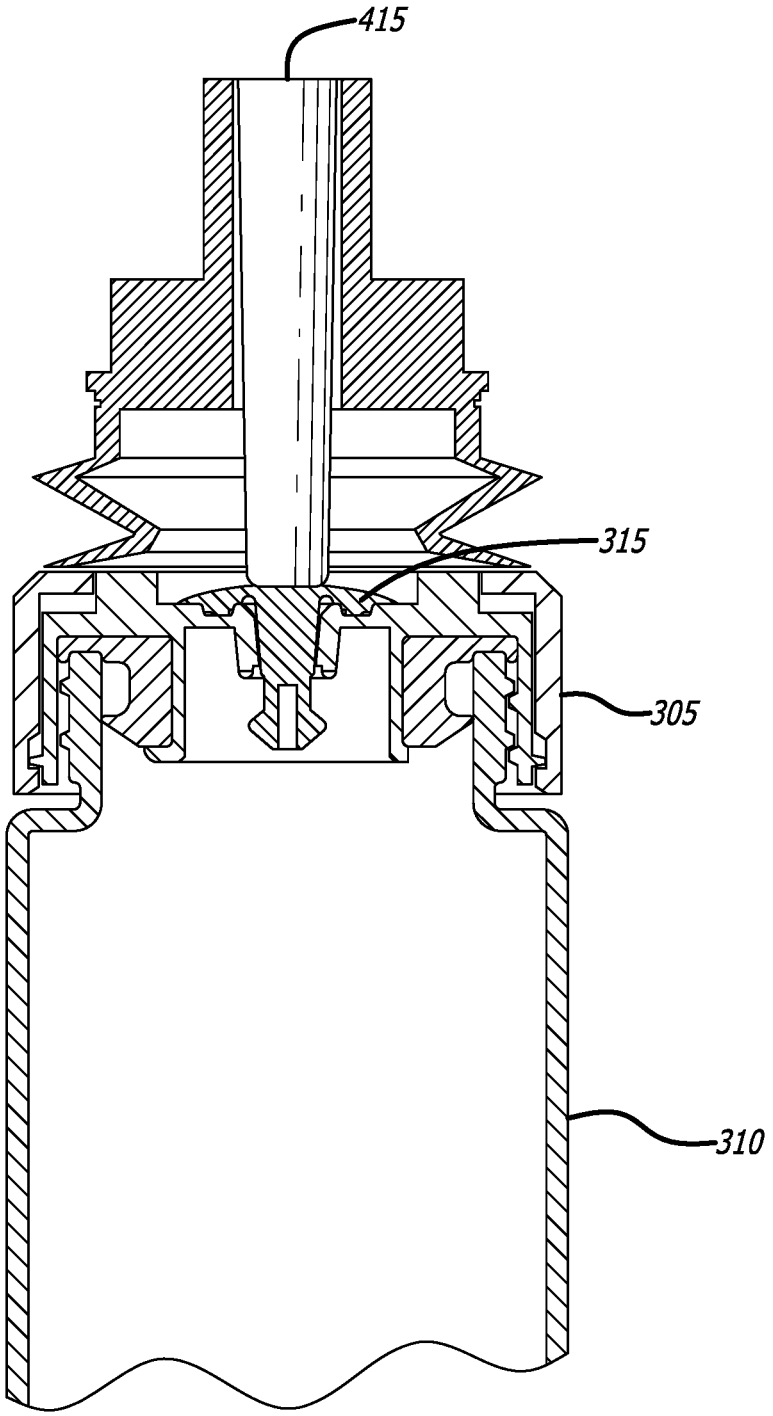
FIG. 6 is a side partial cross-sectional view of the embodiment depicted in FIG. 5 but showing the plug being pushed into a closed, sealed configuration by a piston or rod of the pressure reducing device.

FIG. 5 illustrates how the various embodiments of the present disclosure cooperate to allow evacuation of the air or other gas from a closed container. When fixture 400 is placed upon the upper surface of the cap 305, upward motion of the piston 415, generates a reduced air pressure above plug 315, causing plug 315 to move upwards if plug 315 is not already in an open position. As shown by the arrows, the upward motion of the plug creates a passageway to the interior of container 310 to evacuate air or gas from the interior of the container. In this manner, movement of the piston acts as a pump to pump air or gas from the interior of the container. Alternatively, the piston or rod may be an accessory to a vacuum pump.

When the motion of piston 415 is reversed, plug is drawn downwardly by the reduced pressure in the interior of the container to seal the plug against the cap, closing the air or gas passageway opened when the plug was in its open position. To ensure that plug 315 completely seals against the cap, piston 415 may be extended further downward to contact the top surface of the plug and press the plug firmly against the cap. This downward pressure against the plug has been observed to enhance sealing of the plug against the cap, and to lengthen the time that the plug and cap will maintain the reduced pressure within the interior of the closed container.

A person of ordinary skill in the art will understand that the various plugs of the present disclosure may be considered as one-way valves, that allow gas to be evacuated or drawn form the interior of a container by a device configured to withdraw air or gas from the container, such as, for example a hand pump, electric pump, or the like, and then seal the reduced pressure caused by the pump action inside of the container. The embodiments of the present disclosure are also advantageous because the design and operation of the valve-like plug provide for enhanced sealing, and reducing the amount of leakage of air or other gas into the interior of the closed container from the environment outside of the closed container, providing for a longer useful lifetime of the contents of the closed container.

While particular embodiments of the present invention have been described, it is understood that various different modifications within the scope and spirit of the invention are possible. The invention is limited only by the scope of the appended claims.

We claim:

1. A resealable container cap with a one-way valve to allow a pump to draw a vacuum on a container when the cap is closed on the container, comprising:

a circular cap having an annular wall extending downwards from a top portion, the top portion having a thickness, threads disposed around an inner surface of the annular wall, a first bore extending a from a top surface of the top portion partially through the thickness of the top portion, the bottom of the first bore defining an annular land, a second annular wall extending downwards from a center portion of a bottom surface of the top portion, the second annual wall defining a second bore having a first diameter, a third annular wall extending downwards from the center portion of the bottom surface of the top portion, the third annular wall disposed within the second bore, the third annular configured to have a tapered inner wall defining a tapered third bore having a top diameter that is larger than a bottom diameter, the third bore extending into the first bore; and a moveable plug having an open position and a closed position, the moveable plug also having a round top portion having a bottom surface configured to engage the annular land defined by the first bore, and a thickness and diameter sized to fit within the first bore when the plug is in a closed position, the plug also having a vertical member extending from a bottom surface of the round top portion to a distal end, and having a tapered shape configured to fit into and through the third tapered bore of the cap, the taper of the vertical member cooperating with the third tapered bore to provide a gas passageway between an external wall of the vertical member and an inner wall of the tapered third bore when the moveable plug is in an open position, the distal end of the vertical member configured to retain the vertical member in the tapered third bore when the moveable plug is in the open position.

2. A system for creating and maintaining a reduced pressure within a container, comprising:

a container having a body portion and a neck portion, the container also having a bore through the neck portion to allow access to an interior of the container;

threads disposed on an outer surface of the neck portion;

a gasket mounted on a top edge of the neck portion;

a cap configured to fit over the gasket and neck portion of the container, the cap also having threads disposed on an interior surface of the cap and configured to engage the threads disposed on the outer surface of the neck portion, the cap having a first bore extending from a top surface of a top portion of the cap partially through a thickness of the top portion, a bottom of the first bore defining an annular land, a second annular wall extending downwards from a center portion of a bottom surface of the top portion, the second annual wall defining a second bore having a first diameter, a third annular wall extending downwards from the center portion of the bottom surface of the top portion, the third annular wall disposed within the second bore, the third annular configured to have a tapered inner wall defining a tapered third bore having a top diameter that is larger than a bottom diameter, the third bore extending into the first bore; and, a moveable valve-like plug having an open position and a closed position, the open position creating a passageway through the cap between the interior of the container and the environment, the closed position closing the passageway, the moveable plug also having a round top portion having a bottom surface configured to engage the annular land defined by the first bore, and a thickness and diameter sized to fit within the first bore when the plug is in a closed position, the plug also having a vertical member extending from a bottom surface of the plug to a distal end, and having a tapered shape configured to fit into and through the third tapered bore of the cap, the taper of the vertical member cooperating with the third tapered bore to provide the passageway between an external wall of the vertical member and an inner wall of the tapered third bore when the moveable plug is in an open position, the distal end of the vertical member configured to retain the moveable plug in the third tapered bore when the moveable plug is in the open position.

3. The system of claim 2, further comprising a device configured to mate with the top surface of the cap, the device being configured to be used to generate a decreased pressure above the moveable valve-like plug to move the moveable valve-like plug into the open position.

4. The system of claim 3, wherein the device includes a pump.

5. The system of claim 4, wherein the pump is a moveable piston operating within a close-fitting bore.

6. The system of claim 5, wherein the moveable piston is configured to push the moveable valve-like plug into the closed position.

* * * * *